US009431708B2

(12) United States Patent
Orsi et al.

(10) Patent No.: US 9,431,708 B2
(45) Date of Patent: Aug. 30, 2016

(54) CAPACITIVELY COUPLED COMPOUND LOOP ANTENNA

(71) Applicant: DOCKON AG, Zurich (CH)

(72) Inventors: Ryan James Orsi, San Diego, CA (US); Matthew Robert Foster, San Diego, CA (US); Gregory Poilasne, El Cajon, CA (US)

(73) Assignee: DOCKON AG, Zurich (CH)

( * ) Notice: Subject to any disclaimer, the term of this patent is extended or adjusted under 35 U.S.C. 154(b) by 464 days.

(21) Appl. No.: 13/669,389

(22) Filed: Nov. 5, 2012

(65) Prior Publication Data

US 2013/0113666 A1 May 9, 2013

Related U.S. Application Data

(60) Provisional application No. 61/556,145, filed on Nov. 4, 2011.

(51) Int. Cl.

| | |
|---|---|
| ***H01Q 7/00*** | (2006.01) |
| ***H01Q 9/30*** | (2006.01) |
| ***H01Q 21/29*** | (2006.01) |
| ***H01Q 5/00*** | (2015.01) |
| ***H01Q 5/35*** | (2015.01) |

(52) U.S. Cl.

CPC ..... *H01Q 7/00* (2013.01); *H01Q 5/35* (2015.01); *H01Q 9/30* (2013.01); *H01Q 21/29* (2013.01)

(58) Field of Classification Search

CPC ..... H01Q 7/005; H01Q 7/02; H01Q 7/04; H01Q 7/06; H01Q 7/08

USPC ..... 343/700 MS, 726, 745, 866, 788

See application file for complete search history.

(56) References Cited

U.S. PATENT DOCUMENTS

| | | | |
|---|---|---|---|
| 3,973,263 | A | 8/1976 | Green |
| 4,809,009 | A | 2/1989 | Grimes et al. |
| 5,061,938 | A | 10/1991 | Zahn et al. |
| 5,198,826 | A | 3/1993 | Ito |

(Continued)

FOREIGN PATENT DOCUMENTS

| | | | |
|---|---|---|---|
| EP | 1672735 | A1 | 6/2006 |
| EP | 1684379 | A1 | 7/2006 |

(Continued)

OTHER PUBLICATIONS

International Patent Application No. PCT/IB2012/002884: International Search Report and Written Opinion dated May 3, 2013, 12 pages.

Balanis, "Antenna Theory: A Review,", Proc. IEEE, 80:1, Jan. 1992.

Balanis, "Loop Antennas," Antenna Theory Analysis and Design, 3rd Edition, 2005, pp. 231 to 273.

Chan et al., "Printed Antenna Composed of a Bow-tie Dipole and a Loop," IEEE Antennas and Propagation International Symposium 2007, Jun. 2007, pp. 681-684, IEEE, 1-4244-0878-4/07.

(Continued)

*Primary Examiner* — Sue A Purvis
*Assistant Examiner* — Daniel J Munoz
(74) *Attorney, Agent, or Firm* — Baker & Hostetler LLP

(57) ABSTRACT

A compound loop antenna (CPL) is described that includes a capacitively fed magnetic loop and/or a capacitively fed electric field radiator. Embodiments include single-band CPL antennas and multi-band CPL antennas. The CPL antennas have been reduced in physical size by capacitively feeding the loop and/or radiator. The embodiments include at least one e-field radiation element that is capacitively coupled or not capacitively coupled, at least one magnetic loop element that is capacitively coupled. A continuation of the magnetic loop may be continued with either a wire or a connection to a second layer.

23 Claims, 14 Drawing Sheets

(56) References Cited

U.S. PATENT DOCUMENTS

| | | | | |
|---|---|---|---|---|
| 5,376,942 | A | 12/1994 | Shiga | |
| 5,565,881 | A | 10/1996 | Phillips | |
| 5,751,252 | A | 5/1998 | Phillips | |
| 5,771,024 | A | 6/1998 | Reece | |
| 5,771,025 | A | 6/1998 | Reece | |
| 5,781,159 | A | 7/1998 | Desargant | |
| 5,883,599 | A | 3/1999 | Hall | |
| 5,952,982 | A | 9/1999 | Jorgenson et al. | |
| 6,307,509 | B1 | 10/2001 | Krantz | |
| 6,437,750 | B1 | 8/2002 | Grimes et al. | |
| 6,545,647 | B1 | 4/2003 | Sievenpiper et al. | |
| 6,593,886 | B2 | 7/2003 | Schantz | |
| 6,597,318 | B1 * | 7/2003 | Parsche et al. | 343/700 MS |
| 6,677,901 | B1 | 1/2004 | Nalbandian | |
| 6,853,341 | B1 | 2/2005 | Hellgren | |
| 6,864,856 | B2 | 3/2005 | Lynch et al. | |
| 6,933,895 | B2 | 8/2005 | Mendolia et al. | |
| 7,215,292 | B2 | 5/2007 | McLean | |
| 7,388,550 | B2 | 6/2008 | McLean | |
| 7,528,788 | B2 | 5/2009 | Dunn et al. | |
| 7,629,932 | B2 * | 12/2009 | Wang et al. | 343/702 |
| 7,639,207 | B2 | 12/2009 | Sievenpiper et al. | |
| 7,692,595 | B2 | 4/2010 | Kim | |
| 7,855,689 | B2 | 12/2010 | Fukui et al. | |
| 8,144,065 | B2 | 3/2012 | Brown | |
| 8,164,528 | B2 | 4/2012 | Brown | |
| 8,350,770 | B1 | 1/2013 | Dawson | |
| 2003/0080904 | A1 * | 5/2003 | Chen | 343/700 MS |
| 2004/0135726 | A1 * | 7/2004 | Shamir | H01Q 1/36 343/700 MS |
| 2005/0088342 | A1 | 4/2005 | Parsche | |
| 2005/0243005 | A1 | 11/2005 | Rafi et al. | |
| 2007/0024514 | A1 | 2/2007 | Phillips et al. | |
| 2007/0080878 | A1 | 4/2007 | Mclean | |
| 2007/0182658 | A1 | 8/2007 | Ozden et al. | |
| 2009/0073048 | A1 | 3/2009 | Kim | |
| 2009/0121947 | A1 | 5/2009 | Nysen | |
| 2009/0135066 | A1 | 5/2009 | Raappana | |
| 2009/0160717 | A1 | 6/2009 | Tsutsumi et al. | |
| 2009/0224990 | A1 | 9/2009 | Cezanne et al. | |
| 2010/0103061 | A1 | 4/2010 | Yung | |
| 2010/0171563 | A1 | 7/2010 | Dupuy et al. | |
| 2011/0018776 | A1 | 1/2011 | Brown | |
| 2011/0018777 | A1 | 1/2011 | Brown | |
| 2011/0102283 | A1 | 5/2011 | Chang | |
| 2011/0221642 | A1 * | 9/2011 | Bungo et al. | 343/749 |
| 2012/0044122 | A1 | 2/2012 | An et al. | |
| 2012/0229345 | A1 | 9/2012 | Takaki et al. | |
| 2013/0057440 | A1 | 3/2013 | Brown | |
| 2013/0057441 | A1 | 3/2013 | Brown | |
| 2013/0057442 | A1 | 3/2013 | Brown | |
| 2013/0113666 | A1 | 5/2013 | Orsi et al. | |

FOREIGN PATENT DOCUMENTS

| | | | |
|---|---|---|---|
| EP | 1753080 | A1 | 2/2007 |
| EP | 1973192 | A1 | 9/2008 |
| JP | 03-050922 | A | 2/1991 |
| JP | 2005-0183317 | A | 7/1993 |
| JP | 2003-258546 | A | 9/2003 |
| WO | WO 00/25385 | A | 5/2000 |
| WO | WO 2005/062422 | A1 | 7/2005 |
| WO | WO 2008/083719 | A1 | 7/2008 |
| WO | WO 2009/118565 | A1 | 10/2009 |
| WO | WO2010/126292 | A2 | 11/2010 |
| WO | WO2011/062274 | A1 | 5/2011 |
| WO | WO2011/100618 | A1 | 8/2011 |

OTHER PUBLICATIONS

Cheng, O.K "Optimization techniques for antenna arrays," Proc. IEEE, vol. 59, No. 12, pp. 1664-1674, Dec. 1971.

Chu, L.J., "Physical Limitations of Omni-Directional Antennas," J. Appl. Phys., vol. 19, pp. 1163-1175, Dec. 1948.

Collin, R.E. and S. Rothschild, "Evaluation of antenna Q," IEEE Trans Antennas Propagal., vol. 44, pp. 23-27, 1964.

Fante, R.L., "Quality factor of general ideal antennas," IEEE Trans. Antennas Propag., vol. AP-17, No. 2, pp. 151-155, Mar. 1969.

Grimes, D.M., and C.A. Grimes, "The Complex Poynting Theorem Reactive Power, Radiative Q, and Limitations on Electrically Small Antennas," IEEE, pp. 97-1001, 1995.

Grimes, C.A. and D.M. Grimes, "The Poynting Theorems and the Potential for Electrically Small Antennas," Proceedings IEEE Aerospace Conference, pp. 161-176, 1997.

Grimes et al., "Bandwidth and Q of Antennas Radiating TE and TM Modes", IEEE Transactions on Electromagnetic Compatibility, vol. 37., No. 2, May 1995.

Grimes et al., "Minimum Q of Electrically Small Antennas: A Critical Review", Microwave and Optical Technology Letters, vol. 28., No. 3, Feb. 5, 2001.

Hansen, R.C., "Fundamental limitations in antennas," Proc. IEEE, vol. 69, No. 2, pp. 170-182, Feb. 1981.

Harrington, R.F. "Effect of Antenna Size on Gain, Bandwidth and Efficiency", J. Res. Nat. Bur. Stand., vol. 64D, pp. 1-12, Jan.-Feb. 1960.

International Patent Application No. PCT/US12/53235: International Search Report and Written Opinion dated Nov. 2, 2012, 12 pages.

Irwin, J. David, "Equivalent Impedances", Basic Engineering Circuit Analysis, 7th Ed., A Wiley First Edition, John Wiley and Sons, New York, 2002, pp. 273 to 274.

Kraus, John D., "Capacitors and Capacitance,", Electromagnetics, Second Edition, McGrawHill,1973.

McLean, J.S., "The Application of the Method of Moments to Analysis of Electrically Small 'Compound' Antennas," IEEE EMC Symp., pp. 119-124, Aug. 1995.

McLean, James S., "A Re-examination of the Fundamentai Limits on the Radiation Q of Electrically Small Antennas", IEEE Transactions on Antennas and Propagation, vol. 44, No. 5, May 1996.

Nilsson et al., "Maximum Power Transfer", ElectricCircuits 6th Edition, Prentice-Hall, Inc. Upper Saddle River, New Jersey 07458, 2001, pp. 512-514.

Overfelt, "Colocated Magnetic Loop, Electric Dipole array antenna (preliminary Results)" Sep. 1994.

Sten, J.C.-E., and A. Hujanen, "Notes on the quality factor and bandwidth of radiating systems", Electrical Engineering 84, pp. 189-195, 2002.

Tefiku, F. and C.A. Grimes, "Coupling Between Elements of Electrically Small Compound Antennas," Microwave and Optical Technology Letters, vol. 22, No. 1, pp. 16-21, 1999.

Wheeler, H.A., "Small antennas," IEEE Trans. Antennas Propagal., vol. AP-23, No. 4, pp. 462-469, Jul. 1975.

Wheeler, H.A., Wheeler, "Fundamental Limitations of Small Antennas", Proc. IRE, vol. 35, pp. 1479-1484, Dec. 1947.

Yaghjian, A.D. and S.R. Best, "Impedance, bandwidth, and Q of antennas," IEEE Trans. Antennas Propagal., vol. 53, No. 4, pp. 1298-1324, Apr. 2005.

Yazdanboost, K.Y., Kohno, R., "Ultra wideband L-loop antenna" in Ultra-Wideband, 2005. ICU 2005. 2005 IEEE International Conference on. Issue Date: Sep. 5-8, 2005, pp. 201-205. ISBN: 0-7803-9397-X.

International Patent Application No. PCT/US2014/69627; Int'l Preliminary Report on Patentability; dated Dec. 11, 2015; 19 pages.

* cited by examiner

CAPACITIVELY COUPLED COMPOUND LOOP ANTENNA

CROSS REFERENCE TO RELATED APPLICATIONS

This application claims benefit under 35 U.S.C. §119(e) of U.S. Provisional Application No. 61/556,145, filed Nov. 4, 2011, the contents of which is incorporated herein by reference in its entirety.

TECHNICAL FIELD

Embodiments relate to compound loop antennas (CPL) and particularly to CPL antennas that include a capacitively fed magnetic loop and/or a capacitively fed electric field radiator and/or a direct fed electric field radiator.

BACKGROUND

The ever decreasing size of modern telecommunication devices creates a need for improved antenna designs. Known antennas in devices such as mobile/cellular telephones provide one of the major limitations in performance and are almost always a compromise in one way or another.

In particular, the efficiency of the antenna can have a major impact on the performance of the device. A more efficient antenna will radiate a higher proportion of the energy fed to it from a transmitter. Likewise, due to the inherent reciprocity of antennas, a more efficient antenna will convert more of a received signal into electrical energy for processing by the receiver.

In order to ensure maximum transfer of energy (in both transmit and receive modes) between a transceiver (a device that operates as both a transmitter and receiver) and an antenna, the impedance of both should match each other in magnitude. Any mismatch between the two will result in sub-optimal performance with, in the transmit case, energy being reflected back from the antenna into the transmitter. When operating as a receiver, the sub-optimal performance of the antenna results in lower received power than would otherwise be possible.

Existing simple loop antennas are typically current fed devices, which produce primarily a magnetic (H) field. As such they are not typically suitable as transmitters. This is especially true of small loop antennas (i.e. those smaller than, or having a diameter less than, one wavelength). In contrast, voltage fed antennas, such as dipoles, produce both electric (E) fields and H fields and can be used in both transmit and receive modes.

The amount of energy received by, or transmitted from, a loop antenna is, in part, determined by its area. Typically, each time the area of the loop is halved, the amount of energy which may be received/transmitted is reduced by approximately 3 dB depending on application parameters, such as initial size, frequency, etc. This physical constraint tends to mean that very small loop antennas cannot be used in practice.

Compound antennas are those in which both the transverse magnetic (TM) and transverse electric (TE) modes are excited in order to achieve higher performance benefits such as higher bandwidth (lower Q), greater radiation intensity/power/gain, and greater efficiency.

In the late 1940s, Wheeler and Chu were the first to examine the properties of electrically small (ELS) antennas. Through their work, several numerical formulas were created to describe the limitations of antennas as they decrease in physical size. One of the limitations of ELS antennas mentioned by Wheeler and Chu, which is of particular importance, is that they have large radiation quality factors, Q, in that they store, on time average more energy than they radiate. According to Wheeler and Chu, ELS antennas have high radiation Q, which results in the smallest resistive loss in the antenna or matching network and leads to very low radiation efficiencies, typically between 1-50%. As a result, since the 1940's, it has generally been accepted by the science world that ELS antennas have narrow bandwidths and poor radiation efficiencies. Many of the modern day achievements in wireless communications systems utilizing ELS antennas have come about from rigorous experimentation and optimization of modulation schemes and on air protocols, but the ELS antennas utilized commercially today still reflect the narrow bandwidth, low efficiency attributes that Wheeler and Chu first established.

In the early 1990s, Dale M. Grimes and Craig A. Grimes claimed to have mathematically found certain combinations of TM and TE modes operating together in ELS antennas that exceed the low radiation Q limit established by Wheeler and Chu's theory. Grimes and Grimes describe their work in a journal entitled "Bandwidth and Q of Antennas Radiating TE and TM Modes," published in the IEEE Transactions on Electromagnetic Compatibility in May 1995. These claims sparked much debate and led to the term "compound field antenna" in which both TM and TE modes are excited, as opposed to a "simple field antenna" where either the TM or TE mode is excited alone. The benefits of compound field antennas have been mathematically proven by several well respected RF experts including a group hired by the U.S. Naval Air Warfare Center Weapons Division in which they concluded evidence of radiation Q lower than the Wheeler-Chu limit, increased radiation intensity, directivity (gain), radiated power, and radiated efficiency (P. L. Overfelt, D. R. Bowling, D. J. White, "Colocated Magnetic Loop, Electric Dipole Array Antenna (Preliminary Results)," Interim rept., September 1994).

Compound field antennas have proven to be complex and difficult to physically implement, due to the unwanted effects of element coupling and the related difficulty in designing a low loss passive network to combine the electric and magnetic radiators.

There are a number of examples of two dimensional, non-compound antennas, which generally consist of printed strips of metal on a circuit board. However, these antennas are voltage fed. An example of one such antenna is the planar inverted F antenna (PIFA). The majority of similar antenna designs also primarily consist of quarter wavelength (or some multiple of a quarter wavelength), voltage fed, dipole antennas.

Planar antennas are also known in the art. For example, U.S. Pat. No. 5,061,938, issued to Zahn et al., requires an expensive Teflon substrate, or a similar material, for the antenna to operate. U.S. Pat. No. 5,376,942, issued to Shiga, teaches a planar antenna that can receive, but does not transmit, microwave signals. The Shiga antenna further requires an expensive semiconductor substrate. U.S. Pat. No. 6,677,901, issued to Nalbandian, is concerned with a planar antenna that requires a substrate having a permittivity to permeability ratio of 1:1 to 1:3 and which is only capable of operating in the HF and VHF frequency ranges (3 to 30 MHz and 30 to 300 MHz). While it is known to print some lower frequency devices on an inexpensive glass reinforced epoxy laminate sheet, such as FR-4, which is commonly used for ordinary printed circuit boards, the dielectric losses in FR-4 are considered to be too high and the dielectric constant not sufficiently tightly controlled for such substrates to be used at microwave frequencies. For these reasons, an alumina substrate is more commonly used. In addition, none of these planar antennas are compound loop antennas.

The basis for the increased performance of compound field antennas, in terms of bandwidth, efficiency, gain, and radiation intensity, derives from the effects of energy stored in the near field of an antenna. In RF antenna design, it is desirable to transfer as much of the energy presented to the antenna into radiated power as possible. The energy stored in the antenna's near field has historically been referred to as reactive power and serves to limit the amount of power that can be radiated. When discussing complex power, there exists a real and imaginary (often referred to as a "reactive") portion. Real power leaves the source and never returns, whereas the imaginary or reactive power tends to oscillate about a fixed position (within a half wavelength) of the source and interacts with the source, thereby affecting the antenna's operation. The presence of real power from multiple sources is directly additive, whereas multiple sources of imaginary power can be additive or subtractive (canceling). The benefit of a compound antenna is that it is driven by both TM (electric dipole) and TE (magnetic dipole) sources which allows engineers to create designs utilizing reactive power cancelation that was previously not available in simple field antennas, thereby improving the real power transmission properties of the antenna.

In order to be able to cancel reactive power in a compound antenna, it is necessary for the electric field and the magnetic field to operate orthogonal to each other. While numerous arrangements of the electric field radiator(s), necessary for emitting the electric field, and the magnetic loop, necessary for generating the magnetic field, have been proposed, all such designs have invariably settled upon a three-dimensional antenna. For example, U.S. Pat. No. 7,215,292, issued to McLean, requires a pair of magnetic loops in parallel planes with an electric dipole on a third parallel plane situated between the pair of magnetic loops. U.S. Pat. No. 6,437,750, issued to Grimes et al., requires two pairs of magnetic loops and electric dipoles to be physically arranged orthogonally to one another. U.S. Patent Application US2007/0080878, filed by McLean, teaches an arrangement where the magnetic dipole and the electric dipole are also in orthogonal planes.

Commonly owned U.S. Pat. No. 8,144,065 teaches a linear polarized, multi-layered planar compound loop antenna. Commonly owned U.S. patent application Ser. No. 12/878,018 teaches a linear polarized, single-sided compound loop antenna. Finally, commonly owned U.S. Pat. No. 8,164,528 teaches a linear polarized, self-contained compound loop antenna. These commonly owned patents and applications differ from prior antennas in that they are compound loop antennas having one or more magnetic loops and one or more electric field radiators physically arranged in two dimensions, rather than requiring three-dimensional arrangements of the magnetic loops and the electric field radiators as in the antenna designs by McLean and Grimes et al.

SUMMARY

Embodiments described herein are comprised of a CPL antenna that includes a capacitively fed magnetic loop and/or a capacitively fed electric field radiator. Embodiments include single-band CPL antennas and multi-band CPL antennas. The CPL antennas have been reduced in physical size by capacitively feeding the loop and/or radiator. The embodiments include at least one e-field radiation element that is capacitively coupled or not capacitively coupled, at least one magnetic loop element that is capacitively coupled. Acontinuation of the magnetic loop may be continued with either a wire (3D) or a connection to a second layer (2D).

DETAILED DESCRIPTION OF ILLUSTRATIVE EMBODIMENTS

Compound loop antennas are capable of operating in both transmit and receive modes, thereby enabling greater performance than known loop antennas. The two primary components of a compound loop (CPL) antenna are a magnetic loop that generates a magnetic field (H field) and an electric field radiator that emits an electric field (E field). The H field and the E field must be orthogonal to each other to enable the electromagnetic waves emitted by the antenna to effectively propagate through space. To achieve this effect, the electric field radiator is positioned at the approximate 90 degree electrical position or the approximate 270 degree electrical position along the magnetic loop. The orthogonality of the H field and the E field can also be achieved by positioning the electric field radiator at a point along the magnetic loop where current flowing through the magnetic loop is at a reflective minimum. The point along the magnetic loop of a CPL antenna where current is at a reflective minimum depends on the geometry of the magnetic loop. For example, the point where current is at a reflective minimum may be initially identified as a first area of the magnetic loop. After adding or removing metal to the magnetic loop to achieve impedance matching, the point where current is at a reflective minimum may change from the first area to a second area.

Embodiments described herein are comprised of a CPL antenna that includes a capacitively fed magnetic loop and/or a capacitively fed electric field radiator. Embodiments described herein will be described in reference to single-band 2.4 GHz CPL antennas and 2.4/5.8 GHz multi-band CPL antennas. However, it is to be understood that the principles described herein can be applied to create single-band and multi-band antennas at other frequency bands. These CPL antennas have been reduced in physical size by capacitively feeding the loop and/or radiator. The basic properties of embodiments of such antennas are that at least one e-field radiation element is capacitively coupled or not capacitively coupled, at least one magnetic loop element is capacitively coupled, and the antenna maintains high efficiency. In addition, the continuation of the magnetic loop can be continued with either a wire (3D) or a connection to a second layer (2D).

Figure 1:
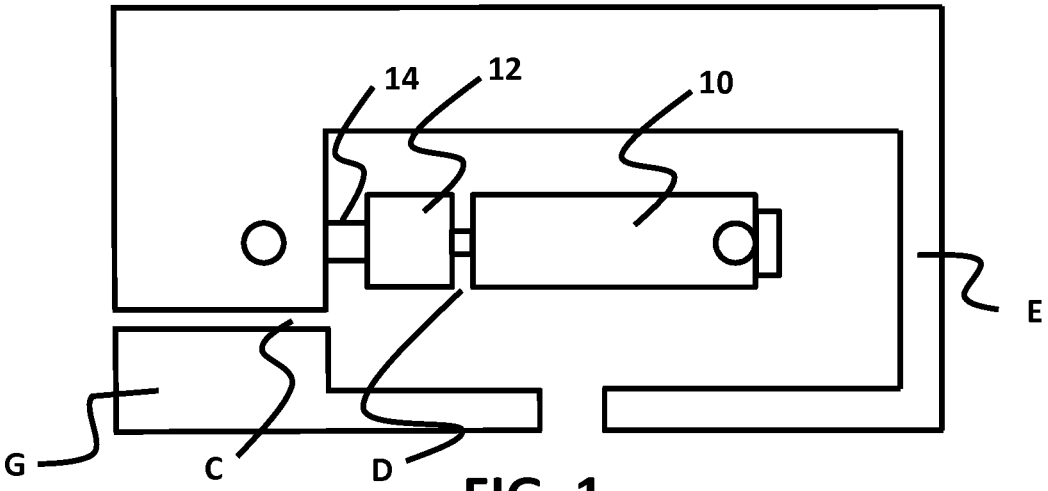
FIG. 1 illustrates a front of an embodiment of an antenna with a capacitively fed magnetic loop and a capacitively fed electric field radiator.
Figure 2:
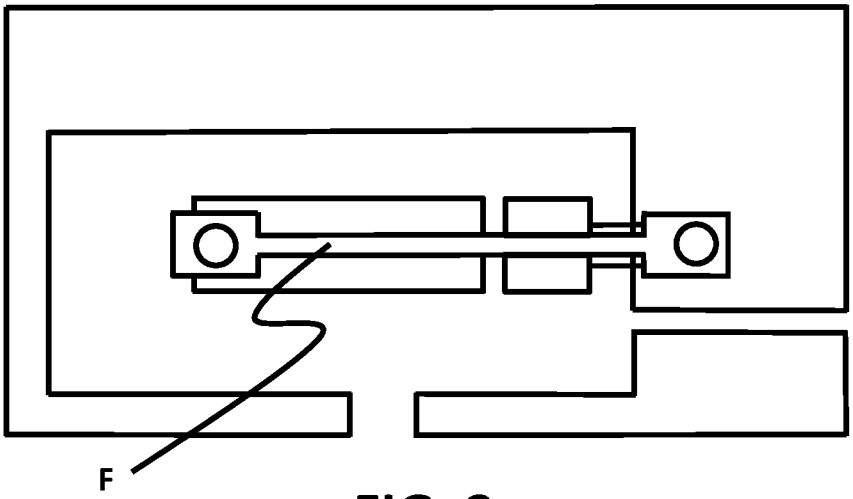
FIG. 2 illustrates a back view of the embodiment of FIG. 1.
Figure 3:
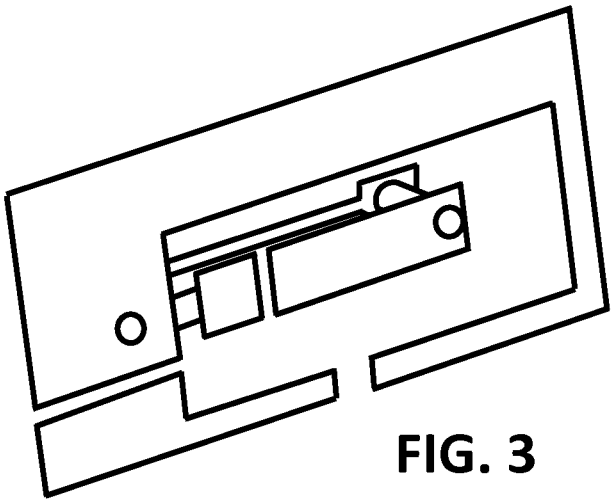
FIG. 3 illustrates a perspective view of the embodiment of FIGS. 1 and 2.

FIG. 1 illustrates an embodiment of a 2.4 GHz antenna with a capacitively fed magnetic loop and a capacitively fed electric field radiator. FIG. 1 illustrates a front view of the antenna, FIG. 2 illustrates a back view of the antenna, and FIG. 3 illustrates a perspective view of the antenna. Element C, may be approximately 0.25 millimeters, is a capacitive gap that results in the lower left portion of the magnetic loop capacitively feeding the rest of the magnetic loop. The smaller the dimension of the capacitive gap, the lower the resulting frequency of the magnetic loop. If the capacitive gap is too large, the capacitive coupling begins to fail and the resonance of the antenna disappears. The position of the capacitive gap C, by moving it vertically along the left side of the magnetic loop, affects the impedance matching. Thus, moving the capacitive gap C up and down may be used to tune the antenna impedance.

Element D, also being approximately 0.25 mm, is a capacitive gap for the electric field radiator. As illustrated in FIGS. 1-3, the electric field radiator is the larger rectangular element 10 inside of the magnetic loop and to the right of the capacitive gap D. To the left of the capacitive gap D is a substantially rectangular shaped radiator feed 12. The radiator feed may be coupled to the magnetic loop via a trace element 14. The electric field radiator may be coupled to the magnetic loop via a trace F on the back plane of the antenna, as illustrated and further described in reference to FIG. 2. The capacitive gap D for the electric field radiator may not be too large, otherwise the capacitive coupling of the electric field radiator begins to fail and the resonance disappears. The position of the capacitive gap D for the electric field radiator also affects the impedance matching, and it can be moved horizontally (left and right) to tune the antenna impedance.

The cut on the magnetic loop that forms the capacitive gap C may result in a monopole resonance being created on the lower left portion of the magnetic loop, indicated by element G. The monopole resonance may be tuned by adjusting the location of capacitive gap C and by adjusting the length of the monopole resonance element G. The monopole resonance G may also be tuned to turn the antenna design into a multi-band antenna.

Element E, referring to the right side of the magnetic loop, may be made thinner (inductive reactance) than the rest of the magnetic loop in order to match the capacitive reactance in the capacitive gap C. While FIG. 1 illustrates an antenna with a capacitive gap C and a wide portion of the magnetic loop on the left side of the magnetic loop, embodiments may consist of antennas with the capacitive gap C and the wide portion of the magnetic loop on the right side of the magnetic loop, and with the thinner portion E of the magnetic loop being on the left side of the magnetic loop.

The inductance and capacitance of the magnetic loop may be tuned by adjusting the width of various portions of the magnetic loop. For instance, the width of the top portion of the magnetic loop may be increased or decreased in order to tune its inductance and reactance. Changes to the geometry of the magnetic loop may also be made to tune the antenna performance. For example, the corners of the substantially rectangular magnetic loop may be cut at an angle, such as a 45 degree angle.

FIG. 2 illustrates a back view of the antenna from FIG. 1. As noted, element F indicates a trace on the bottom layer of the antenna, connecting the electric field radiator to the magnetic loop. The trace may also be placed on the top layer to make a single layer antenna design. The perspective view from FIG. 3 shows that the trace F may be positioned on a bottom layer, and that the trace F may connect directly the magnetic loop to the capacitively coupled electric field radiator.

Figure 4:
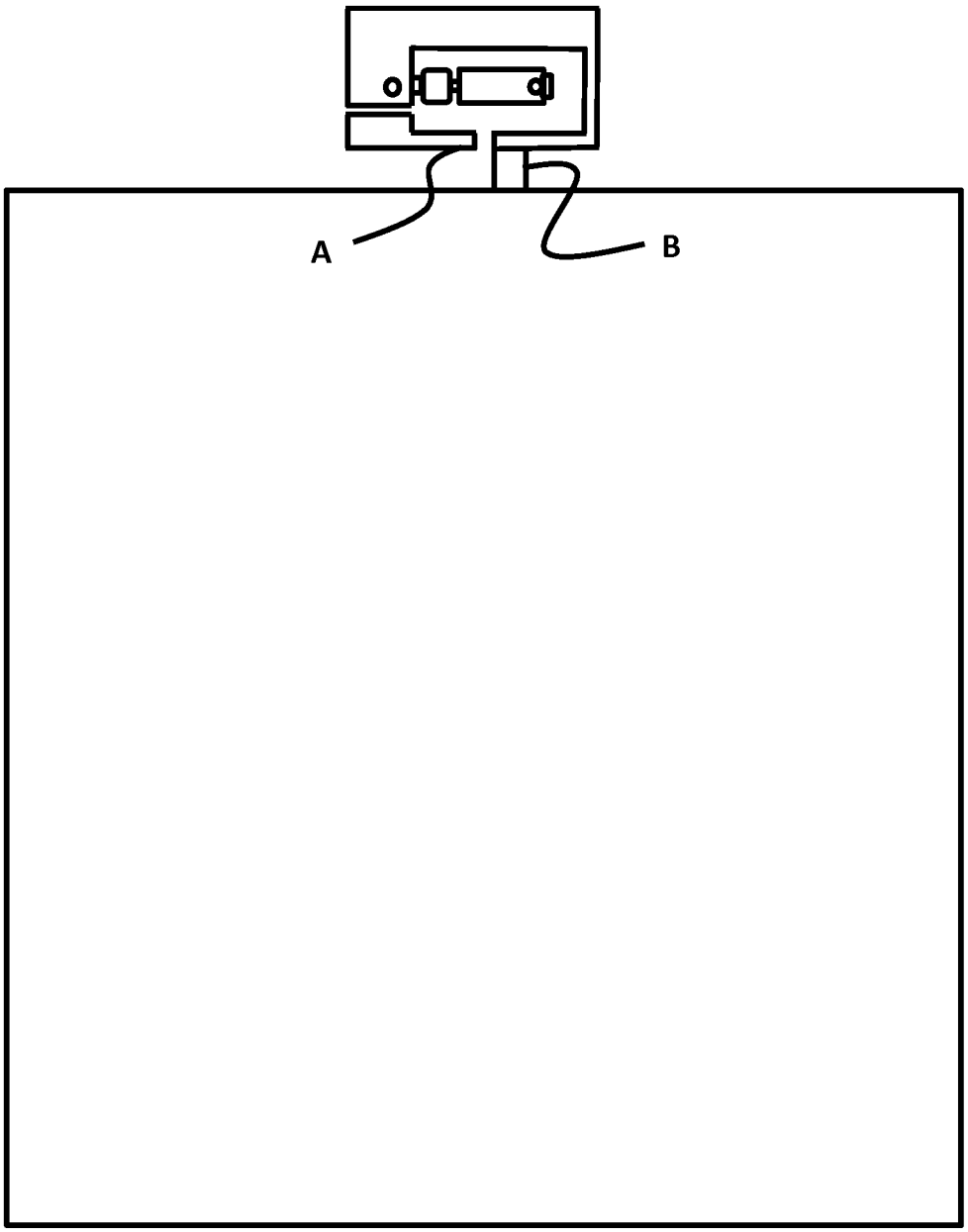
FIG. 4 illustrates an embodiment of an antenna with a feed point and ground connection.

FIG. 4 illustrates the antenna with feed point A and ground connection B. While the embodiments described herein show the antenna having a feed point on the left endpoint of the magnetic loop and a ground connection on the right endpoint of the magnetic loop, alternative embodiments may include an antenna having the feed point on the right endpoint of the magnetic loop and a ground connection on the left endpoint of the magnetic loop.

Embodiments of the 2.4 GHz antenna in FIGS. 1-4 include a capacitively fed magnetic loop and a capacitively fed electric field radiator. However, the electric field radiator need not be capacitively fed. Instead, embodiments can consist of an electric field radiator that is not capacitively fed, but which may either be directly coupled to the magnetic loop or coupled to the magnetic loop via a trace. The antenna can also include more than one electric field radiator inside of the magnetic loop. When including more than one electric field radiator, a first electric field radiator may be capacitively fed while a second electric field radiator is not capacitively fed. Alternatively, all of the radiators may be capacitively fed, directly coupled to the magnetic loop, coupled to the magnetic loop via a trace, or any combination of these.

Compared to simple loop antennas, embodiments described herein have the advantage of being antenna designs that are compound field antennas, easy to tune, fill in nulls in the radiation pattern from the magnetic loop, increase efficiency, increase bandwidth, and are small in physical size. Compared to monopoles, embodiments described herein may have the advantage of being antenna designs that are compound field antennas, stable, increased efficiency, and increased bandwidth.

The electric field radiator may be thought of as a shorted magnetic loop with a trace connected to a first segment and a second segment (radiator feed) separated by a capacitively coupled gap, with the second segment and the magnetic loop connected via return on the back plane of the antenna (or via the first and second segment). The return increases the electrical length of the radiator.

At the 2.4 GHz frequency, the capacitively fed electric field radiator and the capacitively coupled magnetic loop radiate in phase with each other. Specifically, the electric field radiator and the portions of the magnetic loop adjacent to the capacitive gap C radiate in phase with each other at 2.4 GHz. A farfield plot of the 2.4 GHz band for the antenna illustrated on FIGS. 1-4 indicates that the farfield pattern of the antenna is omnidirectional, similar to a dipole pattern.

In an embodiment, a compound loop antenna may comprise a magnetic loop located on a first plane and generating a magnetic field, the magnetic loop including a downstream portion and an upstream portion, the downstream portion separated from the upstream portion by a capacitive gap that capacitively feeds the downstream portion of the magnetic loop, wherein the magnetic loop has a first inductive reactance adding to a total inductive reactance of the antenna, wherein the capacitive gap adds a first capacitive reactance to a total capacitive reactance of the antenna. The compound loop antenna may further comprise an electric field radiator located on the first plane, the electric field radiator coupled to the magnetic loop and configured to emit an electric field orthogonal to the magnetic field, wherein the electric field radiator has a second capacitive reactance adding to the total capacitive reactance, wherein a physical arrangement between the electric field radiator and the magnetic loop results in a third capacitive reactance adding to the total capacitive reactance, and wherein the total inductive reactance substantially matches the total capacitive reactance.

In the embodiment, the antenna may further comprise a radiator feed coupled to the magnetic loop, wherein the electric field radiator is positioned adjacent to the radiator feed, wherein the electric field radiator is separated from the radiator feed by a second capacitive gap that capacitively feeds the electric field radiator, wherein the second capacitive gap has a fourth capacitive reactance adding to the total capacitive reactance. In the embodiment, the antenna may further comprise an electrical trace coupling the radiator feed to the magnetic loop. In the embodiment, the electrical trace may couple the radiator feed to the magnetic loop at a connection point, the connection point including an electrical degree location approximately 90 degrees or approximately 270 degrees from a drive point of the magnetic loop, or a reflective minimum point where a current flowing through the magnetic loop is at a reflective minimum. In the embodiment, the radiator feed may be directly coupled to the magnetic loop.

In the embodiment, the antenna may further comprise an electrical trace coupling the electric field radiator to the magnetic loop. In the embodiment, the electrical trace may couple the electric field radiator to the magnetic loop at a connection point, the connection point including an electrical degree location approximately 90 degrees or approximately 270 degrees from a drive point of the magnetic loop, or a reflective minimum point where a current flowing through the magnetic loop is at a reflective minimum. In the embodiment, the electrical trace may be positioned on a second plane below the first plane.

In the embodiment, the electric field radiator may be directly coupled to the magnetic loop at a connection point, the connection point including an electrical degree location approximately 90 degrees or approximately 270 degrees from a drive point of the magnetic loop, and a reflective minimum point where a current flowing through the magnetic loop is at a reflective minimum. In the embodiment, a first width of a first portion of the magnetic loop may be greater than or less than a second width of a second portion of the magnetic loop. In the embodiment, adjusting a position of the capacitive gap along the magnetic loop may tune an impedance of the antenna.

An embodiment may be directed to compound loop antennas that produce at least dual-band resonances. Embodiments herein may be described in terms of a 2.4/5.8 GHz antenna that covers the WiFi frequencies. Embodiments may also be used in Multiple Input Multiple Output (MIMO) applications. At least three configurations will be described: (1) a first configuration consisting of a CPL antenna with a magnetic loop and a capacitively fed electric field radiator inside of the magnetic loop, (2) a second configuration consisting of a CPL antenna with a magnetic loop and a capacitively fed electric field radiator outside of the magnetic loop; and (3) a third configuration consisting of a CPL antenna with a capacitively fed magnetic loop that generates a first e-field and a connected electric field radiator inside the magnetic loop that combines with the magnetic loop to generate a second e-field.

Figure 5:
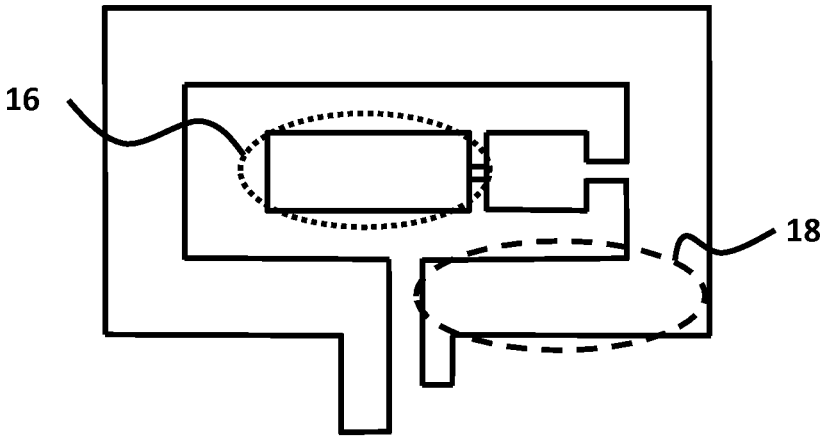
FIG. 5 illustrates a front view of an embodiment of a 2.4/5.8 GHz multi-band CPL antenna.
Figure 6:
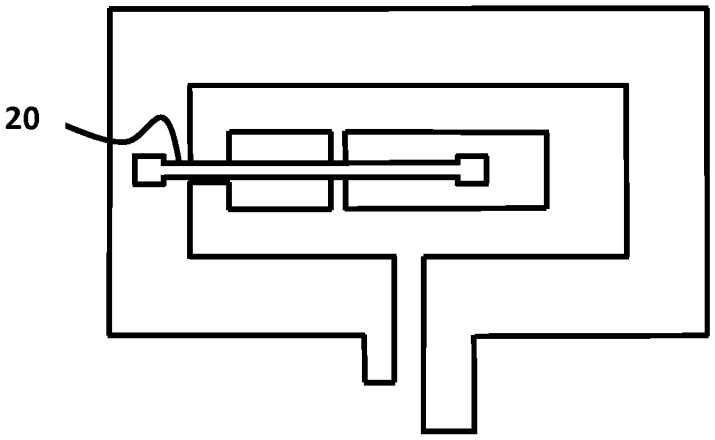
FIG. 6 illustrates a back view of the embodiment of FIG. 5.
Figure 7:
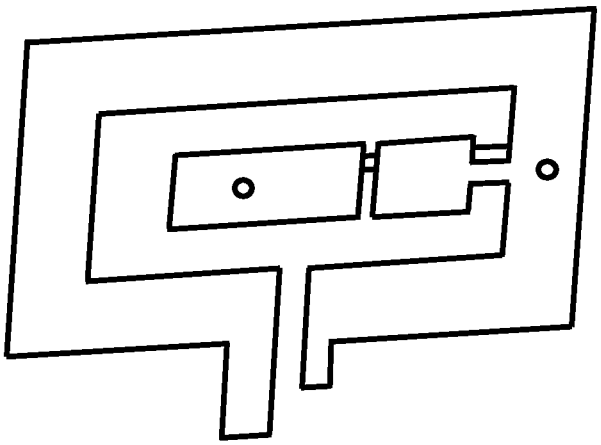
FIG. 7 illustrates a perspective view of the embodiment of FIGS. 5 and 6.

FIG. 5 illustrates a front view of an embodiment of a 2.4/5.8 GHz multi-band CPL antenna. FIG. 6 illustrates a back view of the antenna and FIG. 7 illustrates a perspective view of the antenna. The antenna includes a capacitively fed electric field radiator located inside of a continuous magnetic loop. The electric field radiator is the larger rectangular element located on the inside of the magnetic loop, and the radiator feed is the smaller rectangular element located on the inside of the magnetic loop. The radiator feed is coupled to the magnetic loop via a trace. The electric field radiator is separated from the radiator feed by a capacitive gap that capacitively feeds the electric field radiator. The electric field radiator is coupled to the magnetic loop via a trace on the back side of the antenna as illustrated in FIG. 6. The electric field radiator covers the 2.4 GHz band, as illustrated by the dotted line 16, and the lower right portion of the magnetic loop covers the 5.8 GHz band, as illustrated by the dashed line 18. Specifically, the lower right portion and the right side of the magnetic loop are the radiating elements for the 5.8 GHz band.

As illustrated in FIG. 6, an inductive trace 20 on the back side of the antenna connects the capacitively fed electric field radiator to the magnetic loop. The inductance of the inductive trace compensates for the capacitance caused by the capacitive gap between the electric field radiator and the radiator feed. The capacitive gap acts as a path for the current to flow to ground. In embodiments, the inductive trace on the back side of the antenna may also be placed on the front side of the antenna. Finally, while the antenna illustrated in FIGS. 5-7 includes a continuous loop, embodiments of the multi-band antenna may consist of antennas with a capacitively fed magnetic loop.

Figure 8:
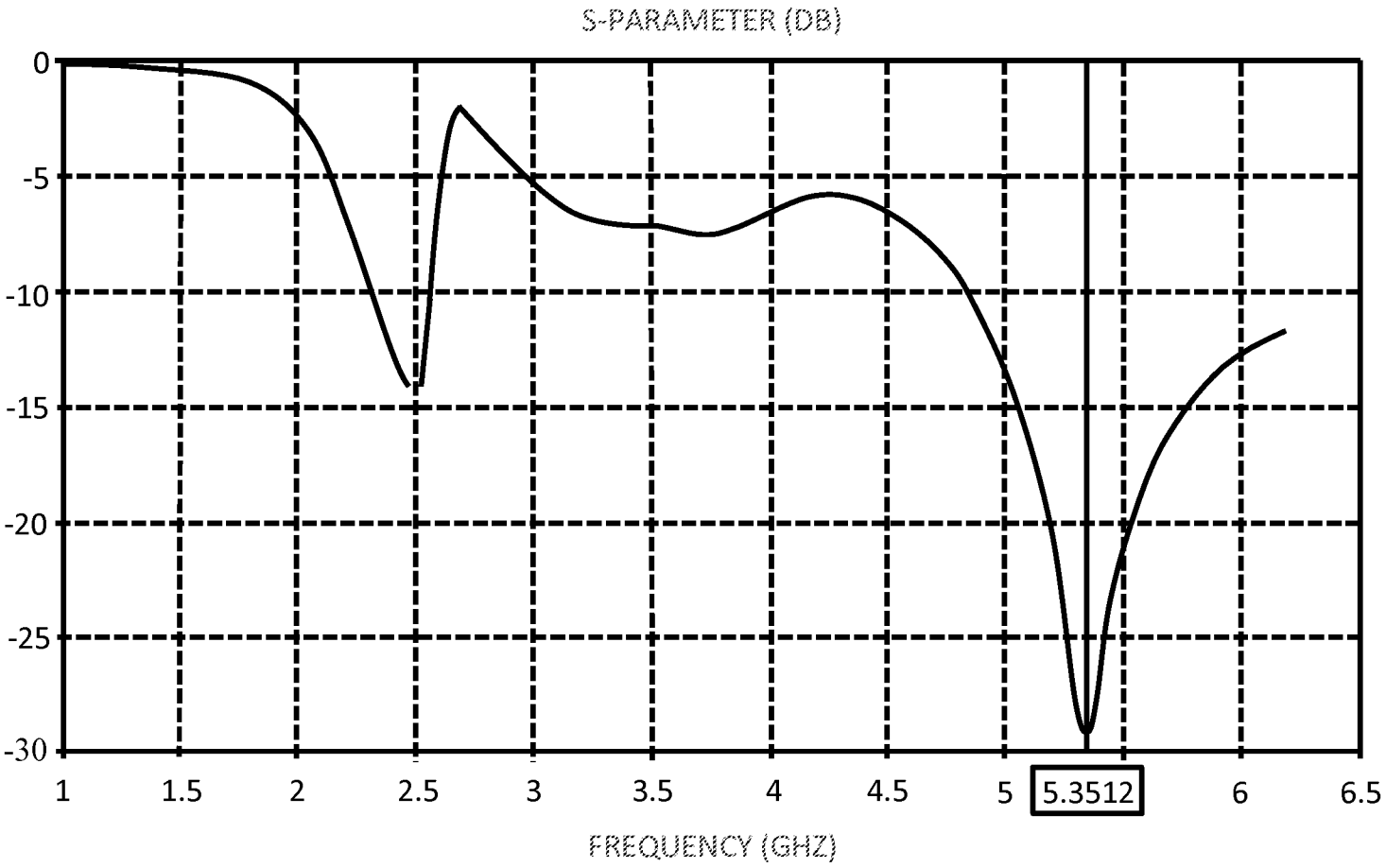
FIG. 8 illustrates a return loss diagram for the 2.4/5.8 GHz bands of the embodiment illustrated in FIGS. 5-7.

FIG. 8 illustrates a return loss diagram for the 2.4/5.8 GHz bands of the embodiment illustrated in FIG. 5-7. The diagram shows that return loss is minimized at approximately the 2.5 GHz band and at the 5.3512 GHz band, but operational within the desired bands of 2.4 and 5.8 GHz.

Figure 9:
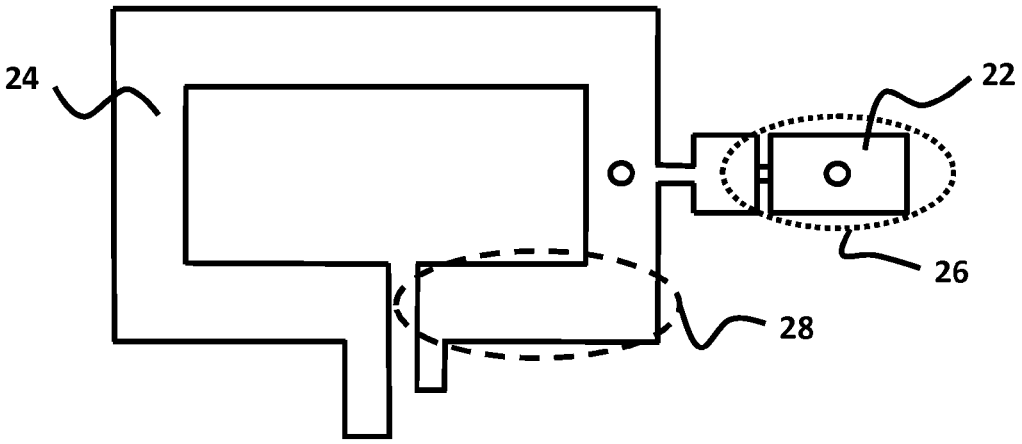
FIG. 9 illustrates a front view of an embodiment of a 2.4/5.8 GHz multi-band antenna.
Figure 10:
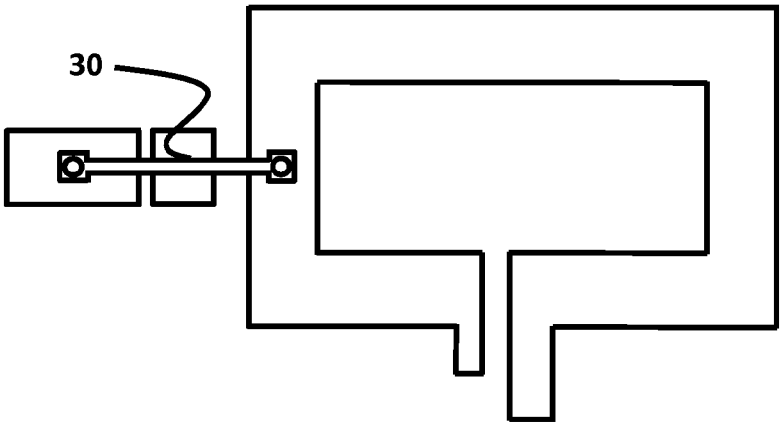
FIG. 10 illustrates a back view of the embodiment of FIG. 9.
Figure 11:
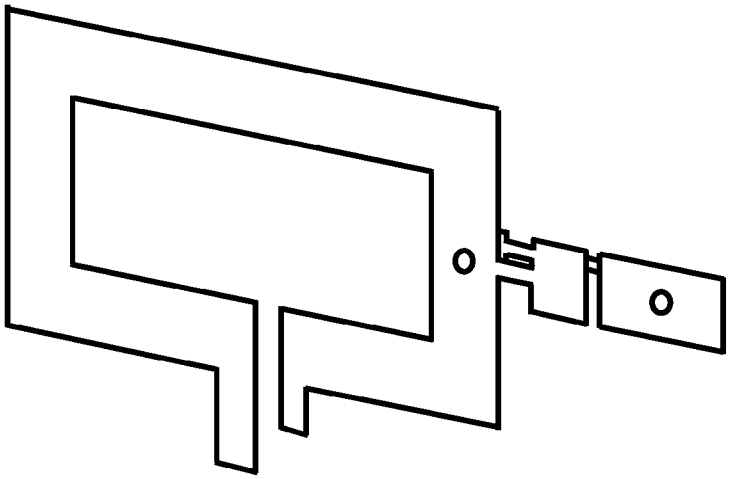
FIG. 11 illustrates a perspective view of the embodiment of FIGS. 9 and 10.

FIG. 9 illustrates a front view of an embodiment of a 2.4/5.8 GHz multi-band antenna, where the capacitively fed electric field radiator 22 is positioned outside of the magnetic loop 24. The electric field radiator covers the 2.4 GHz band, as illustrated by the dotted line 26, while the lower right portion of the magnetic loop and the radiator feed cover the 5.8 GHz band, as illustrated by the dashed line 28. FIG. 10 illustrates a back view of the embodiment of FIG. 9, illustrating the return trace 30. FIG. 11 illustrates a perspective view of the embodiment of FIGS. 9 and 10.

In an embodiment, a multi-band compound loop antenna may comprise: a magnetic loop located on a first plane and generating a magnetic field, wherein the magnetic loop has a first inductive reactance adding to a total inductive reactance of the antenna, wherein a first portion of the magnetic loop is configured to emit a first electric field orthogonal to the magnetic field at a first frequency band; a radiator feed located on the first plane and coupled to the magnetic loop via a first electrical trace, wherein the radiator feed is configured to resonate in phase with the first portion of the magnetic loop at the first frequency band; and an electric field radiator located on the first plane, the electric field radiator coupled to the magnetic loop via a second electrical trace positioned on a second plane below the first plane, the electric field radiator positioned adjacent to the radiator feed and separated from the radiator feed by a capacitive gap, wherein the electric field radiator is configured to emit a second electric field at a second frequency band and orthogonal to the magnetic field, wherein the electric field radiator has a second capacitive reactance adding to the total capacitive reactance, wherein a physical arrangement between the electric field radiator and the magnetic loop results in a third capacitive reactance adding to the total capacitive reactance, and wherein the total inductive reactance substantially matches the total capacitive reactance.

In the embodiment, the electric field radiator and the radiator feed may be positioned inside of the magnetic loop or may be outside of the magnetic loop.

In the embodiment, the first electrical trace may couple to the magnetic loop at a connection point, the connection point including an electrical degree location approximately 90 degrees or approximately 270 degrees from a drive point of the magnetic loop, or a reflective minimum point where a current flowing through the magnetic loop is at a reflective minimum. In the embodiment, the second electrical trace may couple to the magnetic loop at a connection point, the connection point including an electrical degree location approximately 90 degrees or approximately 270 degrees from a drive point of the magnetic loop, or a reflective minimum point where a current flowing through the magnetic loop is at a reflective minimum.

In the embodiment, a first width of the first portion of the magnetic loop may be greater than or less than a second width of a second portion of the magnetic loop. In the embodiment, adjusting a position of the capacitive gap may tune an impedance of the antenna.

Figure 12:
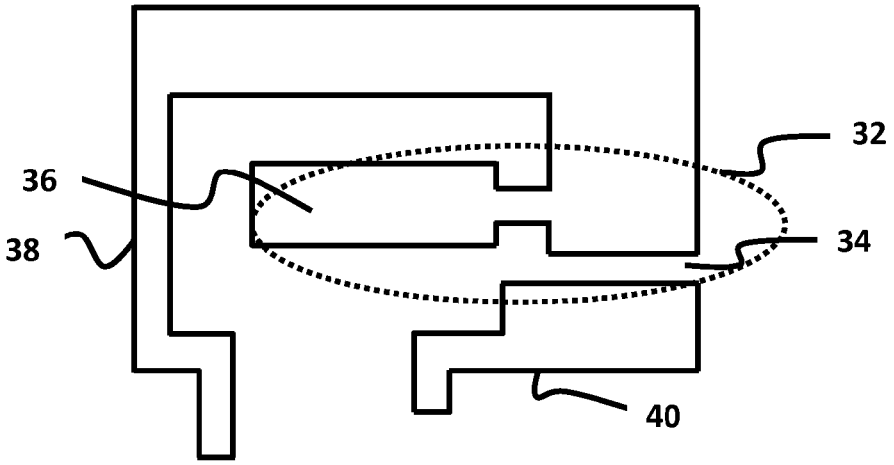
FIGS. 12-14 illustrate a front view, a back view and a perspective view, respectively, of an embodiment a multi-band CPL antenna with a capacitively coupled magnetic loop.
Figure 13:
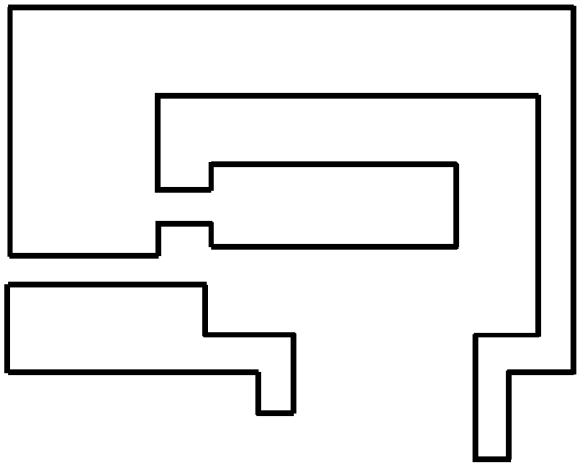
Figure 14:
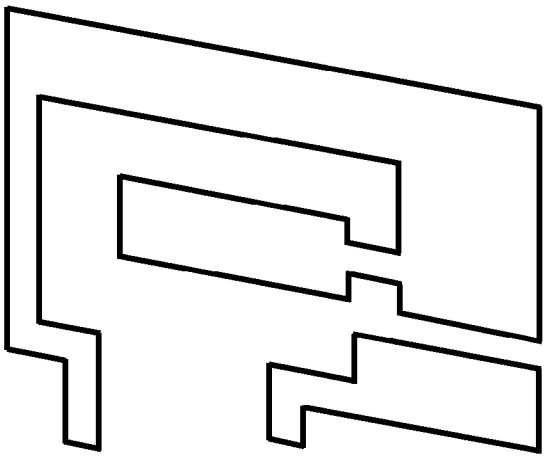

FIGS. 12, 13 and 14 illustrate a front view, a back view and a perspective view, respectively, of an embodiment a multiband antenna with a capacitively coupled magnetic loop. This embodiment operates in the 2.4/5.8 GHz bands and is approximately 0.217 by 0.35 inches in physical size, further illustrating the compact size of the antennas described herein. Farfield patterns for this embodiment at 2.4 GHz indicate that the pattern is omnidirectional, much like a dipole pattern. An E-field plot for this embodiment at 2.4 GHz indicates that a first non-CPL e-field is generated by the loop and a second CPL e-field is generated by a combination of the radiator and the loop, as approximately indicated by the dotted line 32. In particular the magnetic loop can be thought of as being separated by the capacitive gap into an upstream portion and a downstream portion. The upstream portion capacitively feeds the downstream portion of the magnetic loop. The upstream portion of the loop emits the first e-field at a first frequency band. The electric field radiator, which is coupled to the magnetic loop via an electrical trace, in combination with a portion of the upstream portion and a portion the downstream portion emit a second electric field that is orthogonal to the magnetic field at a second frequency band. Hence, the electric field radiator resonates in phase with the upstream portion and the downstream portion of the magnetic loop at the second frequency band. In addition, as with such CPL antennas, the total inductive reactance of the antenna substantially matches the total capacitive reactance of the antenna.

Figure 15:
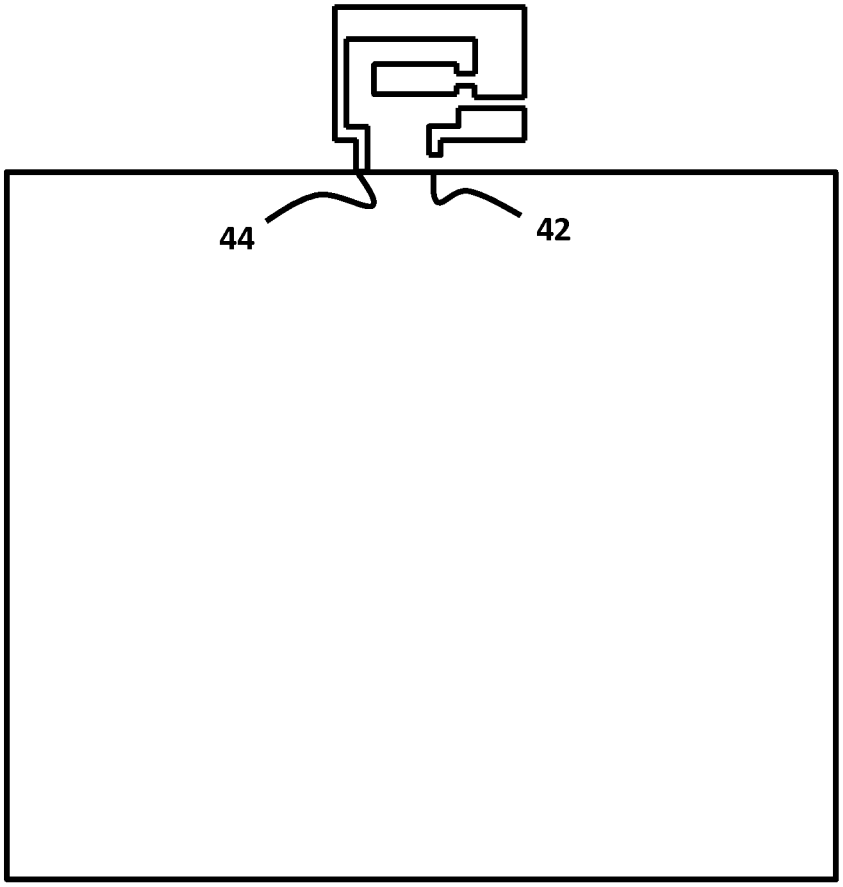
FIG. 15 illustrates the feed point and ground connection of the embodiment of FIG. 12-14 when connected to a load
Figure 16:
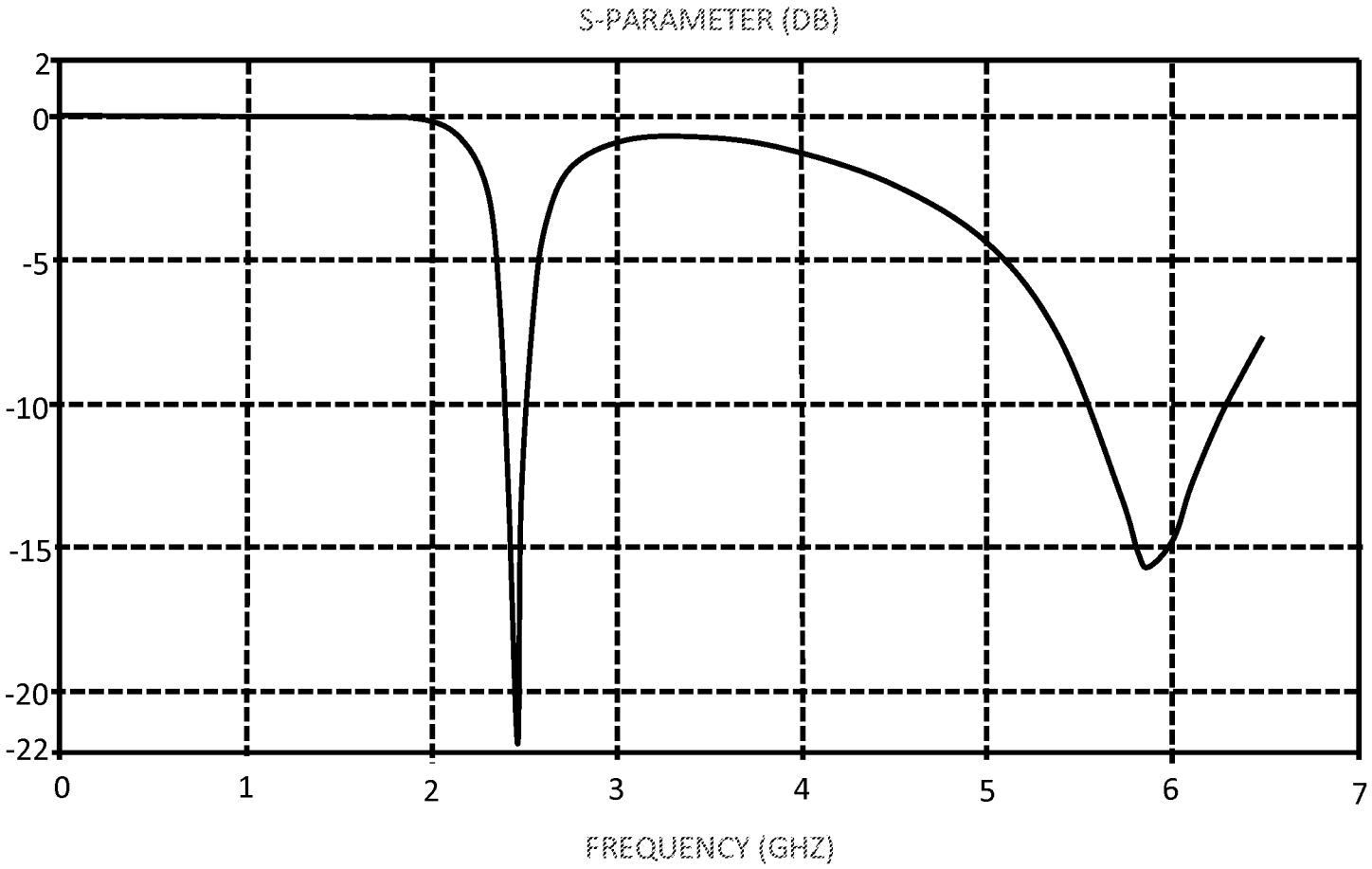
FIG. 16 illustrates a return loss diagram for the embodiment illustrated in FIGS. 12-15.

In the embodiment of FIGS. 12-14, the capacitive gap 34 is approximately 0.018 inches. The smaller this dimension, the lower the frequency of the loop. The capacitive gap 34 cannot become too large (too far apart), or the capacitive coupling may begin to fail and the resonance may disappear. The vertical position of the capacitive gap affects the impedance matching of the antenna, hence moving the position of the gap up or down can be used to tune the antenna. The radiator 36 can also be used to tune the antenna. The skinnier component 38 of the magnetic loop is formed thinner for inductive reactance and to match the capacitive reactance of the capacitive gap 34. The length of the magnetic loop and the first leg 40 of the magnetic loop act as a monopole for the second resonance as illustrated in the return loss chart of FIG. 16, which shows return loss minimized at approximately at 2.4 GHz and 5.8 GHz. FIG. 15 illustrates the feed point 42 and ground connection 44 of the embodiment when connected to a load.

Figure 17:
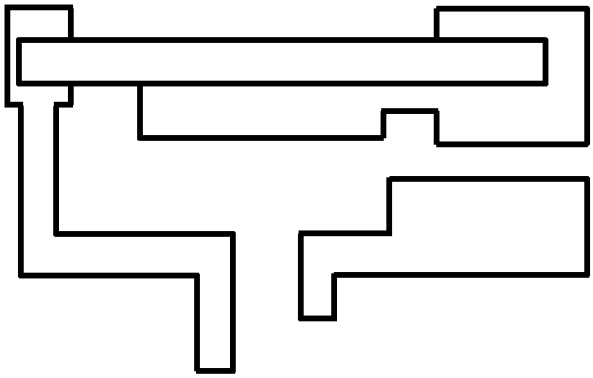
FIGS. 17, 18 and 19 illustrate a front view, a back view and a perspective view, respectively, of an embodiment of a multiband CPL antenna with a capacitively coupled magnetic loop and a cut loop wire completing the loop.
Figure 18:
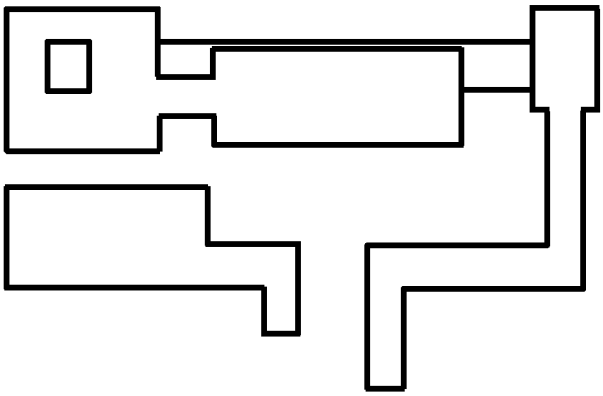
Figure 19:
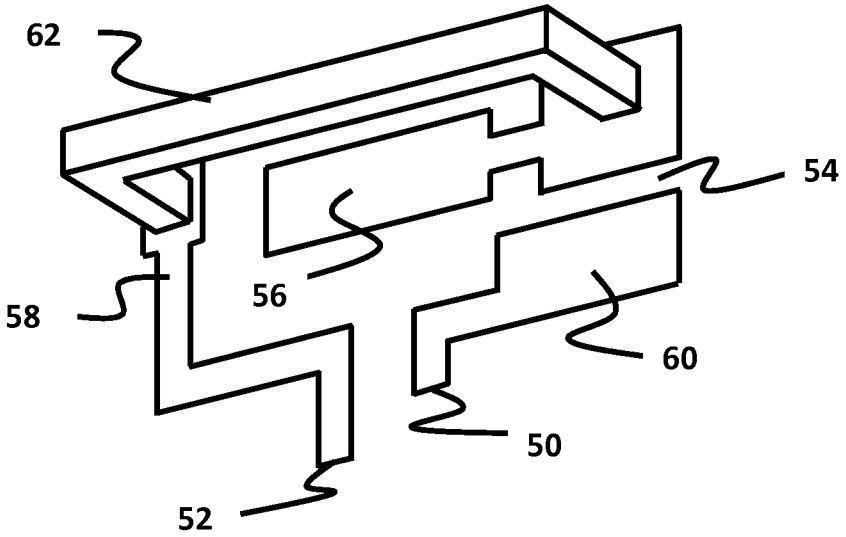
Figure 20:
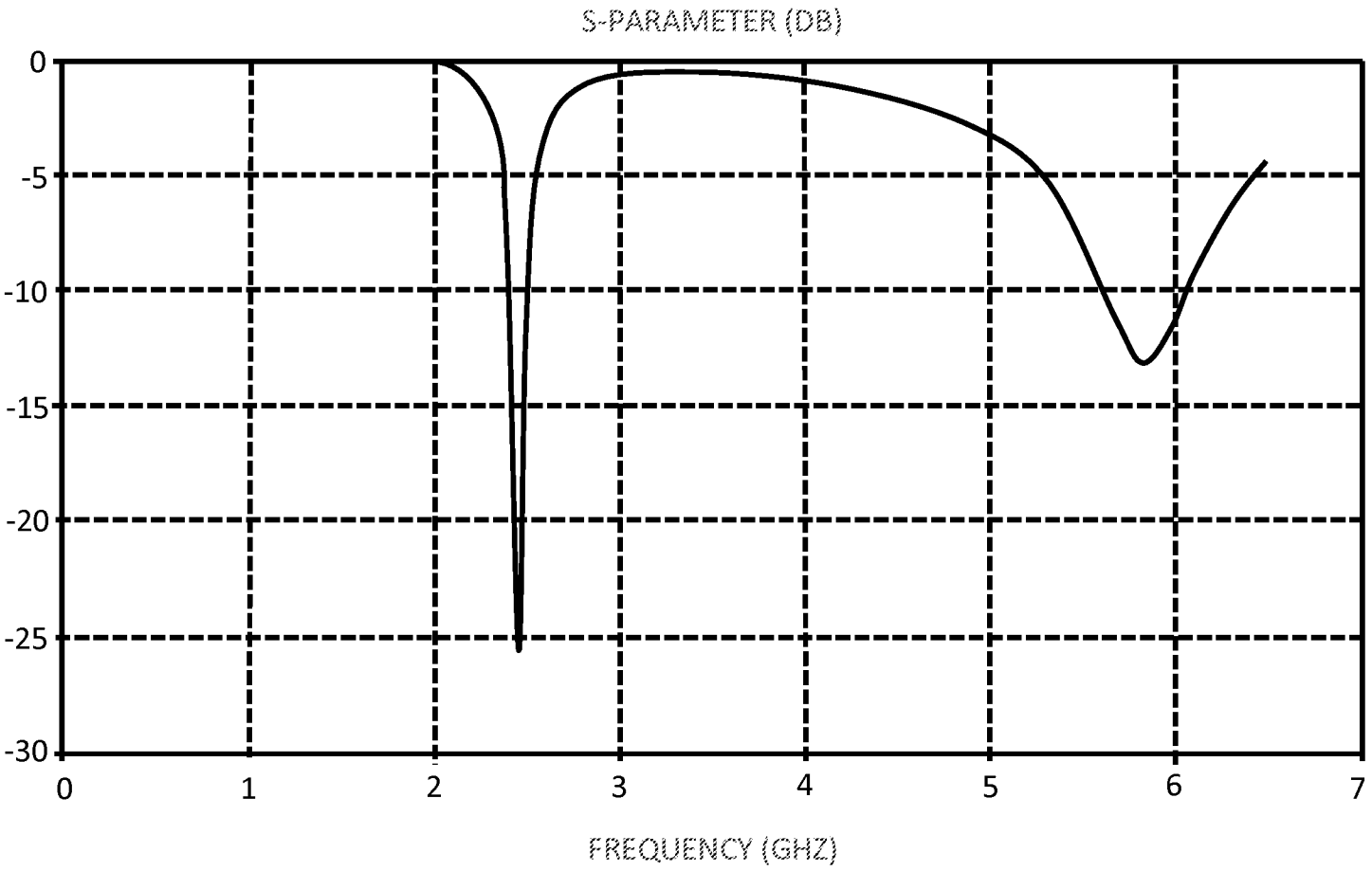
FIG. 20 illustrates a return loss diagram for the embodiment illustrated in FIGS. 17-19.

FIGS. 17, 18 and 19 illustrate a front view, a back view and a perspective view (from the front), respectively, of an embodiment of a multiband CPL antenna with a capacitively coupled magnetic loop and a cut loop wire completing the loop. This embodiment operates in the same manner as the embodiment of FIGS. 12-15 and operates in the 2.4/5.8 GHz bands. This embodiment is, however, approximately 0.195 by 0.359 inches in physical size, further illustrating the compact size of the CPL antennas described herein. As illustrated in FIG. 19, the feed point 50 and ground connection 52 may be connected to a load (not shown). The capacitive gap 54 may be approximately 0.018 inches, the radiator 56, and the skinny matching element 58. The loop length and the first leg 60 of the loop may act as a monopole for the second resonance. The three dimensional (3D) wire 62 may be used to complete the loop while maintaining a smaller two dimensional (2D) space on the printed circuit board (PCB) on which the antenna is situated. When space is at a premium, such as on the PCB of a smart phone or other mobile device, the 0.022 inch difference between the embodiment of FIGS. 12-14 and the embodiment of FIGS. 17-19 may be significant. The return loss chart for this embodiment is illustrated in FIG. 20, which shows return loss minimized at approximately at 2.4 GHz and 5.8 GHz.

Figure 21:
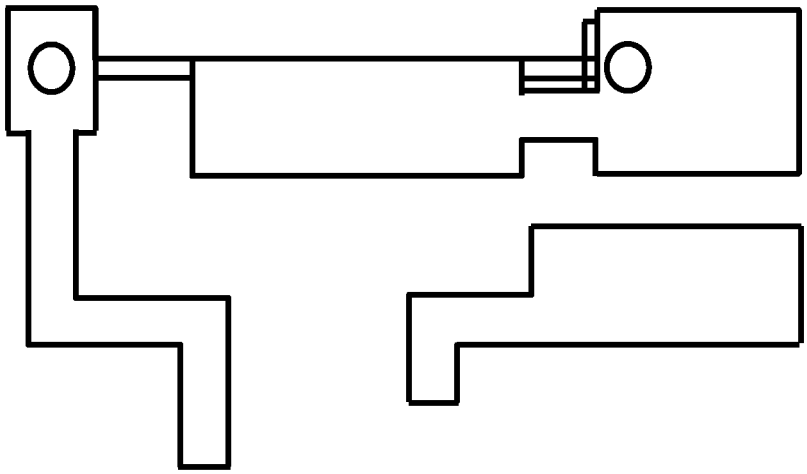
FIGS. 21, 22 and 23 illustrate a front view, a back view and a perspective view, respectively, of an embodiment of a double-sided multiband CPL antenna with a capacitively coupled magnetic loop with the loop completed on a second layer.
Figure 22:
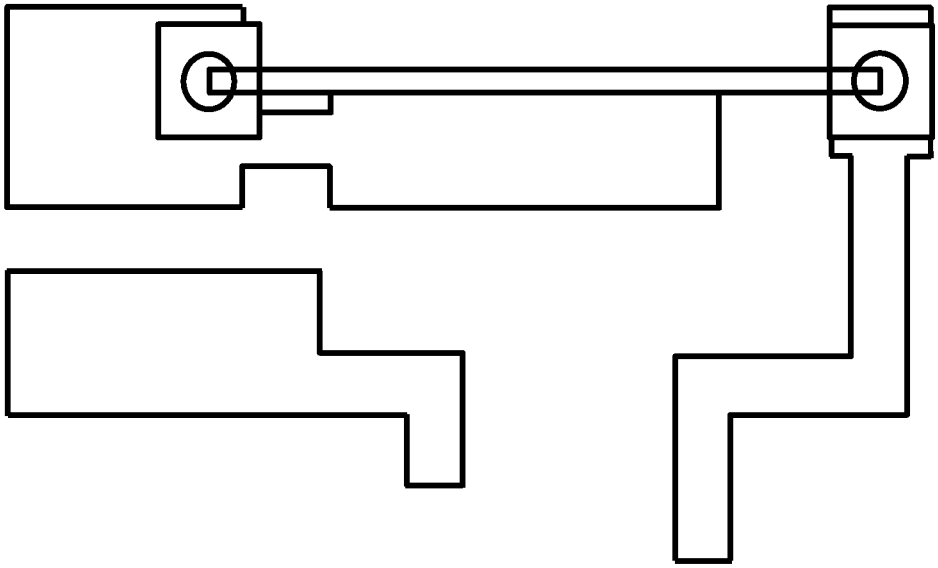
Figure 23:
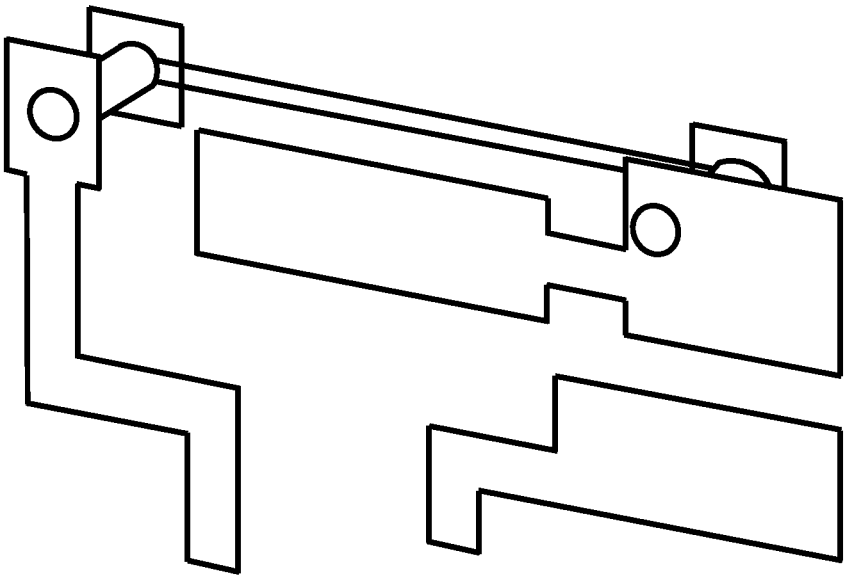
Figure 24:
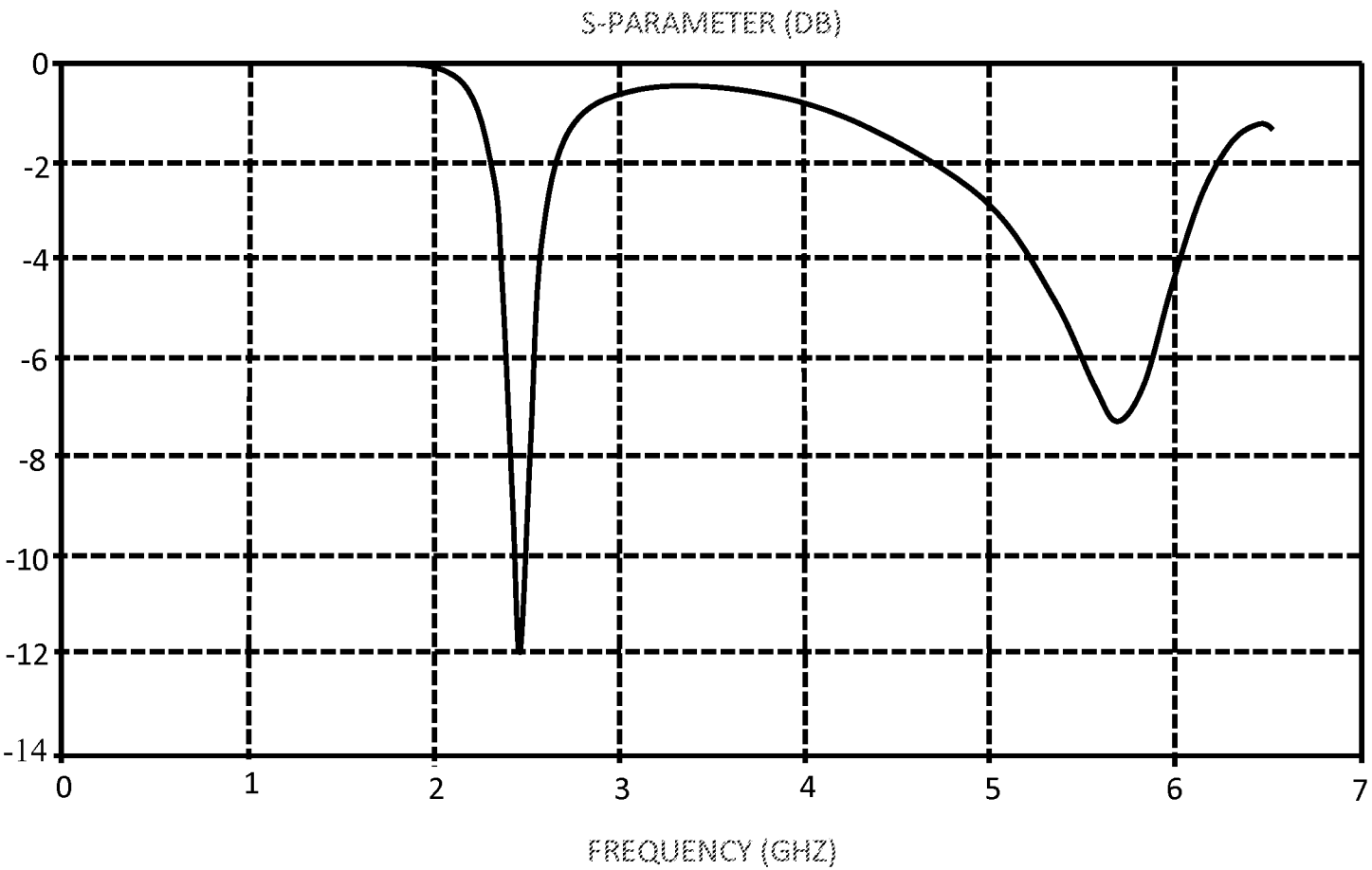
FIG. 24 illustrates a return loss diagram for the embodiment illustrated in FIGS. 21-23.
Figure 25:
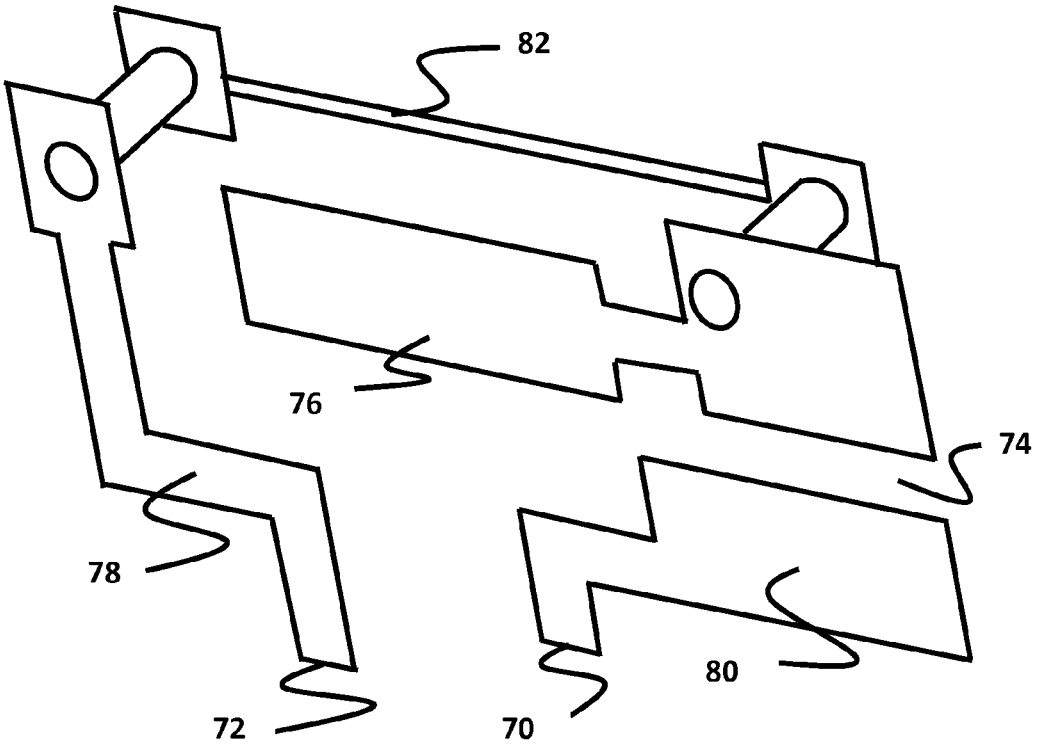
FIG. 25 illustrates further details of the embodiment illustrated in FIG. 23.

FIGS. 21, 22 and 23 illustrate a front view, a back view and a perspective view, respectively, of an embodiment of a double-sided multiband CPL antenna with a capacitively coupled magnetic loop with the loop completed on a second layer. This embodiment operates in the same manner as the prior two embodiments in the 2.4/5.8 GHz bands, but is approximately 0.17 by 0.359 inches in physical size, making it slightly skinnier than the embodiment illustrated in FIGS. 17-19. As illustrated in FIG. 25, the feed point 70 and ground connection 72 may be connected to a load (not shown). The capacitive gap 74 may be approximately 0.022 inches, the radiator 76, and the skinny matching element 78. The loop length and the first leg 80 of the loop may act as a monopole for the second resonance. The extension to the second layer 82 may be used to complete the loop while maintaining a smaller 2D space on the PCB on which the antenna is situated. The width and length of the extension 82 may also be used to tune the antenna, and physical shape may be meandered to add more inductance to the antenna, if needed. The return loss chart for this embodiment is illustrated in FIG. 24, which shows return loss minimized at approximately at 2.4 GHz and 5.8 GHz.

In an embodiment a multi-band compound loop antenna may comprise: a magnetic loop at least partially located on a first plane and generating a magnetic field, the magnetic loop including a downstream portion and an upstream portion, the downstream portion separated from the upstream portion by a capacitive gap that capacitively feeds the downstream portion of the magnetic loop, the upstream portion configured to emit a first electric field at a first frequency band and orthogonal to the magnetic field, wherein the capacitive gap adds a first capacitive reactance to a total capacitive reactance of the antenna; and an electric field radiator located on the first plane, the electric field radiator coupled to the magnetic loop via an electrical trace, wherein the electric field radiator coupled with the upstream portion and the downstream portion of the magnetic loop is configured to emit a second electric field orthogonal to the magnetic field at a second frequency band, wherein the electric field radiator is configured to resonate in phase with the upstream portion and the downstream portion of the magnetic loop at the second frequency band, and wherein a total inductive reactance of the antenna substantially matches the total capacitive reactance of the antenna.

In the embodiment, the electric field radiator may be positioned inside of the magnetic loop. In the embodiment, the electrical trace may couple to the magnetic loop at a connection point, the connection point including an electrical degree location approximately 90 degrees or approximately 270 degrees from a drive point of the magnetic loop, or a reflective minimum point where a current flowing through the magnetic loop is at a reflective minimum. In the embodiment, a first width of a first portion the downstream portion of the magnetic loop is greater than or less than a second width of a second portion of the downstream portion of the magnetic loop.

In the embodiment, the capacitive gap may add a capacitive reactance to a total capacitive reactance of the antenna, and adjusting a position of the capacitive gap may tune an impedance of the antenna.

In the embodiment, the downstream portion may be separated into a first part on the first plane and a second part on the first plane and include a three dimensional wire extending away from the first plane that couples the first part to the second part, or a third part on a second plane that couples the first part to the second part. In the embodiment, a width and a length of the third part may be used to tune the antenna and a physical shape of the third part may be used to add inductance to total inductive reactance of the antenna.

While the present disclosure illustrates and describes several embodiments, it is to be understood that the techniques described herein can have a multitude of additional uses and applications. Accordingly, the invention should not be limited to just the particular description and various drawing figures contained in this specification that merely illustrate various embodiments and application of the principles of such embodiments.

What is claimed:

1. A compound loop antenna, comprising:

a magnetic loop located on a first plane and generating a magnetic field, the magnetic loop including a downstream portion and an upstream portion, the upstream portion connected to a feed, the downstream portion separated from the upstream portion by a capacitive gap that capacitively feeds the downstream portion of the magnetic loop and causes at least in part a first electric field orthogonal to the magnetic field to be emitted from the upstream portion;

an electric field radiator located on the first plane, the electric field radiator coupled to the downstream portion of the magnetic loop at approximately a 90 electrical degrees location relative to the feed, a 270 electrical degrees location relative to the feed, or a reflective minimum point where a current flowing through the magnetic loop is at a reflective minimum and configured to emit a second electric field orthogonal to the magnetic field;

a radiator feed coupled to the magnetic loop, wherein at least a first portion of the electric field radiator is separated from the radiator feed by a second capacitive gap that capacitively feeds at least the first portion of the electric field radiator; and an electrical return trace coupling the electric field radiator to the magnetic loop, wherein the electrical return trace is positioned on a second plane below the first plane.

2. The antenna as recited in claim 1, further comprising an electrical trace coupling at least a second portion of the radiator feed to the magnetic loop, wherein the second capacitive gap is between the first portion of the electric field radiator and the second portion of the electric field radiator.

3. The antenna as recited in claim 1, wherein a first width of a first portion of the magnetic loop is greater than or less than a second width of a second portion of the magnetic loop.

4. The antenna as recited in claim 1, wherein adjusting a position of the capacitive gap along the magnetic loop tunes an impedance of the antenna.

5. The antenna as recited in claim 1, wherein the first electric field and the second electric field are at a same frequency and radiate in phase at the same frequency.

6. The antenna as recited in claim 1, wherein the first electric field and the second electric field are at different frequencies.

7. A multi-band compound loop antenna, comprising:

a magnetic loop located on a first plane and generating a magnetic field, wherein a first portion of the magnetic loop is configured to emit a first electric field orthogonal to the magnetic field at a first frequency band;

a radiator feed located on the first plane and coupled to the magnetic loop, wherein the radiator feed is configured to resonate in phase with the first portion of the magnetic loop at the first frequency band; and an electric field radiator located on the first plane, the electric field radiator coupled to the magnetic loop via an electrical return trace positioned on a second plane below the first plane, the electric field radiator positioned adjacent to the radiator feed and separated from the radiator feed by a capacitive gap, wherein the electric field radiator is configured to emit a second electric field at a second frequency band and orthogonal to the magnetic field.

8. The antenna as recited in claim 7, wherein the electric field radiator and the radiator feed are positioned inside of the magnetic loop.

9. The antenna as recited in claim 7, wherein the electric field radiator and the radiator feed are positioned outside of the magnetic loop.

10. The antenna as recited in claim 7, wherein the radiator feed couples to the magnetic loop at a connection point, the connection point including an electrical degree location approximately 90 degrees or approximately 270 degrees from a drive point of the magnetic loop, or a reflective minimum point where a current flowing through the magnetic loop is at a reflective minimum.

11. The antenna as recited in claim 7, wherein the electrical return trace couples to the magnetic loop at a connection point, the connection point including an electrical degree location approximately 90 degrees or approximately 270 degrees from a drive point of the magnetic loop, or a reflective minimum point where a current flowing through the magnetic loop is at a reflective minimum.

12. The antenna as recited in claim 7, wherein a first width of the first portion of the magnetic loop is greater than or less than a second width of a second portion of the magnetic loop.

13. The antenna as recited in claim 7, wherein adjusting a position of the capacitive gap tunes an impedance of the antenna.

14. A multi-band antenna, comprising:

a magnetic loop at least partially located on a first plane and generating a magnetic field, the magnetic loop including a downstream portion and an upstream portion, the upstream portion connected to a feed, the downstream portion separated from the upstream portion by a capacitive gap that capacitively feeds the downstream portion of the magnetic loop, the upstream portion configured to emit a first electric field at a first frequency band, wherein the downstream portion is separated into a first part on the first plane and a second part on the first plane and includes a three dimensional wire extending away from the first plane that couples the first part to the second part; and an electric field radiator located on the first plane, the electric field radiator coupled to the downstream portion of the magnetic loop at approximately a 90 electrical degrees location relative to the feed, a 270 electrical degrees location relative to the feed, or a reflective minimum point where a current flowing through the magnetic loop is at a reflective minimum, wherein the electric field radiator couples with the upstream portion and the downstream portion of the magnetic loop to emit a second electric field orthogonal to the magnetic field at a second frequency band, wherein the electric field radiator is configured to resonate in phase with the upstream portion and the downstream portion of the magnetic loop at the second frequency band.

15. The antenna as recited in claim 14, wherein the electric field radiator is positioned inside of the magnetic loop.

16. The antenna as recited in claim 14, wherein the electric field radiator is coupled to the magnetic loop via an electrical trace at a connection point, the connection point including an electrical degree location approximately 90 degrees or approximately 270 degrees from a drive point of the magnetic loop, or a reflective minimum point where a current flowing through the magnetic loop is at a reflective minimum.

17. The antenna as recited in claim 14, wherein a first width of a first portion the downstream portion of the magnetic loop is greater than or less than a second width of a second portion of the downstream portion of the magnetic loop.

18. The antenna as recited in claim 14, wherein adjusting a position of the capacitive gap tunes an impedance of the antenna.

19. The antenna as recited in claim 14, wherein the first electric field and the second electric field are at a same frequency and radiate in phase at the same frequency.

20. The antenna as recited in claim 14, wherein the first electric field and the second electric field are at different frequencies.

21. A multi-band antenna, comprising a magnetic loop at least partially located on a first plane and generating a magnetic field, the magnetic loop including a downstream portion and an upstream portion, the upstream portion connected to a feed, the downstream portion separated from the upstream portion by a capacitive gap that capacitively feeds the downstream portion of the magnetic loop, the upstream portion configured to emit a first electric field at a first frequency band, wherein the downstream portion is separated into a first part on the first plane, a second part on the first plane and a third part on a second plane that couples the first part to the second part; and an electric field radiator located on the first plane, the electric field radiator coupled to the downstream portion of the magnetic loop at approximately a 90 electrical degrees location relative to the feed, a 270 electrical degrees location relative to the feed, or a reflective minimum point where a current flowing through the magnetic loop is at a reflective minimum, wherein the electric field radiator couples with the upstream portion and the downstream portion of the magnetic loop to emit a second electric field orthogonal to the magnetic field at a second frequency band, wherein the electric field radiator is configured to resonate in phase with the upstream portion and the downstream portion of the magnetic loop at the second frequency band.

22. The antenna as recited in claim 21, wherein a width and a length of the third part is used to tune the antenna.

23. The antenna as recited in claim 21, wherein a physical shape of the third part is used to add inductance to a total inductive reactance of the antenna.

* * * * *